US011148153B2

(12) United States Patent
Watkins et al.

(10) Patent No.: US 11,148,153 B2
(45) Date of Patent: Oct. 19, 2021

(54) ACTIVE COOLING OF COLD-SPRAY NOZZLES

(71) Applicants: James J. Watkins, South Hadley, MA (US); David Schmidt, Amherst, MA (US); Jacobo Morere Rodriguez, Amherst, MA (US); Victor K. Champagne, Dudley, MA (US)

(72) Inventors: James J. Watkins, South Hadley, MA (US); David Schmidt, Amherst, MA (US); Jacobo Morere Rodriguez, Amherst, MA (US); Victor K. Champagne, Dudley, MA (US)

(73) Assignees: University of Massachusetts, Boston, MA (US); The United States of America as Represented by the Secretary of the Army, Adelphi, MD (US)

( * ) Notice: Subject to any disclaimer, the term of this patent is extended or adjusted under 35 U.S.C. 154(b) by 42 days.

(21) Appl. No.: 16/389,668

(22) Filed: Apr. 19, 2019

(65) Prior Publication Data

US 2020/0023390 A1 Jan. 23, 2020

Related U.S. Application Data

(60) Provisional application No. 62/660,368, filed on Apr. 20, 2018.

(51) Int. Cl.
*B05B 7/14* (2006.01)
*C23C 24/04* (2006.01)

(52) U.S. Cl.
CPC ..... *B05B 7/1404* (2013.01); *B05B 7/1486* (2013.01); *C23C 24/04* (2013.01)

(58) Field of Classification Search
CPC ..... C23C 24/04
See application file for complete search history.

(56) References Cited

U.S. PATENT DOCUMENTS 6,217,803 B1 * 4/2001 Uozumi ..... B22D 11/145 164/418
2007/0000787 A1 * 1/2007 Siljan ..... C25C 3/08 205/381
2010/0136242 A1 * 6/2010 Kay ..... B05B 7/1486 427/427
2010/0170937 A1 * 7/2010 Calla ..... C23C 24/04 228/165

* cited by examiner

*Primary Examiner* — Robert A Vetere
(74) *Attorney, Agent, or Firm* — Schwegman Lundberg & Woessner, P.A.

(57) ABSTRACT

Various embodiments disclosed relate to a method of cold-spray deposition involving cooling the cold-spray nozzle by at least one of expanding and vaporizing a compressed cooling fluid in proximity to the cold-spray nozzle. The present disclosure also includes a cold-spray deposition spray head, a cooling jacket for a cold-spray deposition nozzle and a cold-spray deposition system comprising the same.

20 Claims, 3 Drawing Sheets

ACTIVE COOLING OF COLD-SPRAY NOZZLES

CROSS-REFERENCE TO RELATED APPLICATION

This application claims the benefit of priority to U.S. Provisional Patent Application Ser. No. 62/660,368 entitled "ACTIVE COOLING OF COLD-SPRAY NOZZLES," filed Apr. 20, 2018, the disclosure of which is incorporated herein in its entirety by reference.

STATEMENT OF GOVERNMENT SUPPORT

This invention was made with Government support under W911NF-15-2-0026 and W911NF-15-2-0024 awarded by the U.S. Army Research Laboratory. The Government has certain rights in this invention.

BACKGROUND

Cold-spray technique is a deposition process in which particles are accelerated in a high-velocity stream of gas and sprayed upon a substrate to produce a surface coating by means of ballistic impingement. The high-velocity gas stream can be generated, for example, by expansion of a pressurized, preheated gas through a converging-diverging de Laval nozzle. Particles sprayed at high-velocity, upon impact with the substrate, can deform and create a bond with the substrate. Thus, cold-spray deposition can be performed at temperatures below the melting point of the particles being deposited. As the process continues, particles may also form bonds with other deposited material which results in a uniform coating with very little porosity and high bond strength. (See, Champagne, Victor K., The cold-spray materials deposition process. Fundamentals and applications. Woodhead Publishing Limited, 2007). Cold-spray deposition is useful for dimensional restoration, providing wear and corrosion resistant coatings and producing near net shaped parts. Cold-spray deposition finds applications in the aerospace, automotive, nuclear, medical and electronics industries.

A significant challenge which can arise in this technique is the appearance of clogging in the inside of the nozzle during use. Clogging can require halting deposition and can be fatal to equipment due to physical damage to the inside of the nozzle. In some cases, chemical treatment of the nozzle can permit the nozzle to be reused but in other cases the nozzle must be discarded. The problem of clogging prevents certain types of particles from being used in cold-spray deposition or severely limits the time which certain particles can be sprayed. Halted deposition, chemical treatments and discarded equipment contribute to significant costs and inefficiency.

Water cooled jackets have been investigated which circulate room temperature water over the outer diameter of a cold-spray nozzle in an attempt to reduce nozzle temperature to prevent clogging. However, such water-cooled jackets have proven insufficient to prevent clogging and to extend spray times. (X. Wang, B. Zhang, J. Lv, and S. Yin. Investigation on the Clogging Behavior and Additional Wall Cooling for the Axial-Injection Cold Spray Nozzle. Journal of Thermal Spray Technology, 24 (4), 696-701, 2015).

SUMMARY OF THE DISCLOSURE

The present disclosure provides a method of cold-spray deposition which includes cooling a cold-spray nozzle by providing a compressed cooling fluid which expands, vaporizes, or both, in proximity to the nozzle to effect cooling. The method may include mixing a powder with a heated and pressurized process gas to produce a powder-gas mixture; flowing the powder-gas mixture through a nozzle to produce an accelerated powder-gas mixture; spraying the accelerated powder-gas mixture onto a substrate to deposit the powder; and cooling the nozzle by at least one of expanding and vaporizing a compressed cooling fluid in proximity to the nozzle.

The present disclosure also provides a spray head for a cold-spray deposition system, the spray head including a cold-spray nozzle, a cooling jacket, one or more cooling fluid inlets and one or more cooling fluid outlets. The cooling jacket may be coaxially oriented around the cold-spray nozzle to provide an annular outer channel between an inner wall of the cooling jacket and an outer wall of the cold-spray nozzle. The one or more cooling fluid inlets and one or more cooling fluid outlets may be in communication with the outer channel. The cooling fluid outlet or outlets may also communicate the outer channel to an area of ambient pressure. The cooling fluid inlet provides a compressed cooling fluid to the outer channel and the compressed cooling fluid cools the outer wall of the cold-spray nozzle by at least one of expanding and vaporizing in the outer channel.

The present disclosure also provides a cooling jacket for a cold-spray nozzle, the cooling jacket including a rigid body, a nozzle channel, an out channel, one or more cooling fluid inlets and one or more cooling fluid outlets. The nozzle channel may extend through the rigid body from a nozzle entry port to a nozzle exit port. The outer channel may be oriented coaxial to the nozzle channel and extend at least a portion of the length of the nozzle channel. The one or more cooling fluid inlets and one or more cooling fluid outlets may be in communication with the outer channel. The cooling fluid inlet or inlets may provide a compressed cooling fluid to the outer channel. The cooling fluid outlet or outlets may communicate with the outer channel to an area of ambient pressure. The cooling jacket is configured to secure placement of the cold-spray nozzle through the length of the nozzle channel.

Advantages, some of which are unexpected, are achieved by various embodiments of the present disclosure. In various embodiments, the present invention can reduce the temperature outside of a cold-spray deposition nozzle and can reduce the frequency or risk of clogging of the nozzle during cold-spray deposition. Various embodiments of the present invention can increase the time until first clog or the volume of powder sprayed until first clog, thus permitting extended cold-spray deposition. Cold-spray deposition can be extended by at least 2.5-20 minutes without clogging compared to cold-spray deposition without the compressed cooling fluid. In various embodiments, the cold-spray deposition can advantageously be performed for at least or about 6, 10, 15, or 20 minutes or more, without clogging. The present disclosure can provide reduced clogging during cold-spray deposition performed at a temperature between 200° C. and 1000° C. The present disclosure can also provide reduced clogging during cold-spray deposition performed at a pressure of 20-40 bar. The present disclosure can permit cold-spray deposition conditions having a combination of particles, temperatures, pressures and spray duration which would otherwise result in a clogged nozzle, e.g., within 5 minutes. For example, the present disclosure can provide a method of cold-spray deposition of nickel particles at a temperature of 200° C. to 1000° C. and a pressure of 20-40

Bar for 6, 10, 15, or 20 minutes or more without clogging. In various embodiments, the present invention can reduce the extent of clogging, for example, such that a greater proportion of clogged nozzles can be cleaned and that fewer nozzles need to be discarded. In various embodiments, the present invention increases the working life of nozzles.

In various embodiments of the present invention, the cooled nozzle permits an expensive, high-velocity process gas such as helium to be replaced with less expensive process gases such as nitrogen, thus reducing costs.

BRIEF DESCRIPTION OF THE FIGURES

The drawings illustrate generally, by way of example, but not by way of limitation, various embodiments discussed in the present document.

DETAILED DESCRIPTION

Figure 1A:
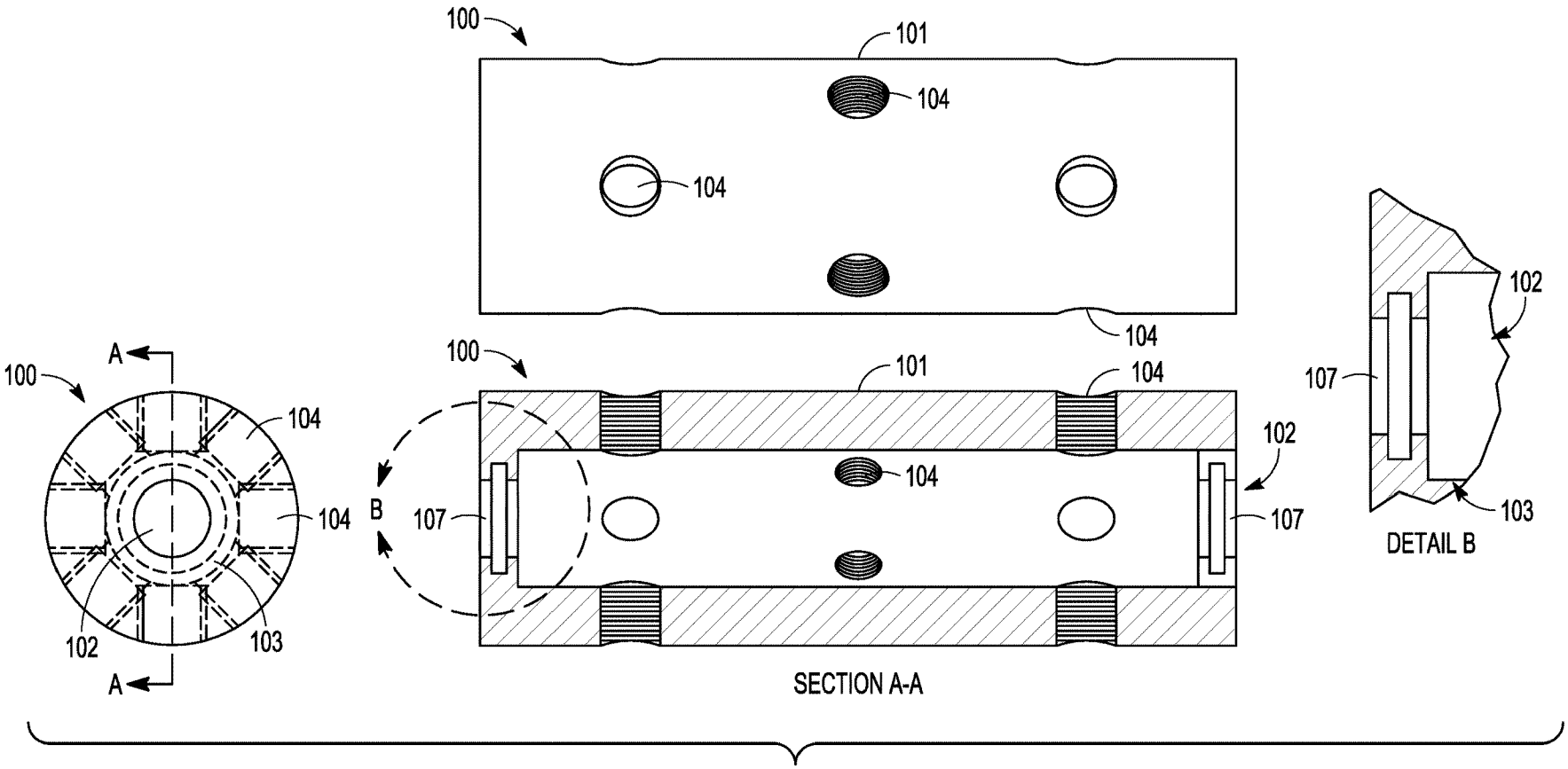
FIG. 1A provides a cooling jacket for use in cooling a cold-spray nozzle of a cold-spray deposition system, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

The term "clogging" as used herein refers to when a cold-spray nozzle suffers from adhesion or accumulation of powder particles on the inner surfaces of the cold-spray nozzle such that continued flow from the nozzle is disrupted or otherwise physical damaged due to the adhesion or accumulation of particles.

Method of Cold-Spray Deposition

The present disclosure provides a method of cold-spray deposition which includes cooling a cold-spray nozzle by providing a compressed cooling fluid which expands, vaporizes, or both, in proximity to the nozzle to effect cooling. The method may include mixing a powder with a heated and pressurized process gas to produce a powder-gas mixture; flowing the powder-gas mixture through a nozzle to produce an accelerated powder-gas mixture; spraying the accelerated powder-gas mixture onto a substrate to deposit the powder; and cooling the nozzle by at least one of expanding and vaporizing a compressed cooling fluid in proximity to the nozzle.

The method may comprise expanding the compressed cooling fluid in proximity to the nozzle, vaporizing the compressed cooling fluid in proximity to the nozzle, or both.

The method may comprise flowing the compressed cooling fluid along an outer wall of the nozzle or flowing the compressed cooling fluid through a spray head which comprises the nozzle and a cooling jacket which surrounds at least a portion of the nozzle, or both. The compressed cooling fluid may be flowed through the spray head without mixing with the heated and pressurized process gas, the powder-gas mixture and the accelerated powder-gas mixture. The method may comprise at least one of expanding and vaporizing the compressed cooling fluid in the spray head. The compressed cooling fluid can be provided to the nozzle or the spray head at a flow rate of at least or about 50 mL/min, 55 mL/min, 60 mL/min, 65 mL/min, 70 mL/min, 75 mL/min, 80 mL/min, 85 mL/min, 90 mL/min, 95 mL/min, 100 mL/min, 105 mL/min, 110 mL/min, 115 mL/min, 120 mL/min, 130 mL/min, 150 mL/min, 160 mL/min, 170 mL/min, 180 mL/min, 190 mL/min, or 200 mL/min.

The method may comprise at least one of expanding and vaporizing the compressed cooling fluid in an outer channel between an inner wall of the cooling jacket and an outer wall of the nozzle. The method may comprise at least one of expanding and vaporizing the compressed cooling fluid along an outer wall of the nozzle.

In various embodiments, spraying may be performed for at least or about 3.5, 4, 5, 6, 7, 8, 9, 10, 11, 12, 13, 14, 15, 16, 17, 18, 19, 20, 21, 22, 23, 24, 25, or 30 minutes without clogging the nozzle. In various embodiments, spraying may be performed for at least or about 3.5, 4, 5, 6, 7, 8, 9, 10, 11, 12, 13, 14, 15, 16, 17, 18, 19, 20, 21, 22, 23, 24, 25, or 30 minutes at a temperature from about 350° C. to about 600° C. without clogging the nozzle.

In various embodiments, the method may be performed by flowing the powder-gas mixture through an inner channel, corresponding to the channel of the nozzle that accelerates the powder-gas mixture, and flowing the compressed cooling fluid through an outer channel, which can be provided by the cooling jacket. The outer channel can be oriented coaxial or adjacent to the inner channel and can extend at least a portion of the length of the nozzle.

In various embodiments, the compressed cooling fluid does not mix with the heated and pressurized process gas and powder-gas mixture. In other embodiments, the compressed cooling fluid may be mixed with the heated and pressurized process gas, the powder-gas mixture, or both.

Cold-Spray Deposition Spray Head

The present disclosure also provides a spray head for a cold-spray deposition system, the spray head including a cold-spray nozzle, a cooling jacket, one or more cooling fluid inlets and one or more cooling fluid outlets. The cooling jacket may be coaxially oriented around the cold-spray nozzle to provide an annular outer channel between an inner wall of the cooling jacket and an outer wall of the cold-spray nozzle. The one or more cooling fluid inlets and one or more cooling fluid outlets may be in communication with the outer channel. The cooling fluid outlet or outlets may also communicate the outer channel to an area of ambient pressure. The cooling fluid inlet provides a compressed cooling fluid to the outer channel and the compressed cooling fluid cools the outer wall of the cold-spray nozzle by at least one of expanding and vaporizing in the outer channel.

In various embodiments, the outer channel is not in communication with the inner channel.

The spray head may be configured to flow a process gas and powder through the cold-spray nozzle and flow compressed cooling fluid through the inner channel.

The compressed cooling fluid may be provided in liquid form, vapor form, or a combination thereof. The compressed cooling fluid can be provided to the spray head at a flow rate of at least or about 50 mL/min, 55 mL/min, 60 mL/min, 65 mL/min, 70 mL/min, 75 mL/min, 80 mL/min, 85 mL/min, 90 mL/min, 95 mL/min, 100 mL/min, 105 mL/min, 110 mL/min, 115 mL/min, 120 mL/min, 130 mL/min, 150 mL/min, 160 mL/min, 170 mL/min, 180 mL/min, 190 mL/min, or 200 mL/min.

The cold-spray nozzle may be configured to accept a mixture of powder and heated and pressurized process gas and to produce an accelerated powder-gas mixture.

The outer channel may be aligned with the outer wall of at least one of a converging segment, a diverging segment and a throat segment of the cold-spray nozzle.

The compressed cooling fluid may cool the outer wall of at least one of a converging segment, a diverging segment and a throat segment of the cold-spray nozzle.

The outer channel may comprise a single contiguous channel or it may be a plurality of channels. The outer channel may be configured parallel to the cold-spray nozzle. The outer channel may be configured to encircle the cold-spray nozzle.

In various embodiments, one or more cooling fluid inlets directs the compressed cooling fluid to the outer wall of at least one of a converging segment, a diverging segment and a throat segment of the cold-spray nozzle The spray head may comprise one or more cooling fluid pumps which compress cooling fluid from a cooling fluid source and provides compressed cooling fluid to the one or more cooling fluid inlets.

The spray head may comprise two or more cooling fluid pumps linked to continuously compress cooling fluid from the cooling fluid source and continuously provide compressed cooling fluid to the one or more cooling fluid inlets.

The spray head may also comprise a cooling jacket. The cold-spray nozzle and the cooling jacket may be arranged such that the cold-spray nozzle represents an inner channel and the cooling jacket provides an outer channel. The cold-spray nozzle and the cooling jacket may be arranged such that the cold-spray nozzle represents an inner channel and the cooling jacket together with the outer wall of the cold-spray nozzle provides an outer channel. The inner channel and outer channel may be arranged to constitute a concentric nozzle. The cold-spray nozzle may accept a pressurized gas or a pressurized powder-gas mixture from a chamber. The cooling jacket may accept the compressed cooling fluid.

The spray head may be configured such that two separate fluid streams traverse the spray head. The spray head may be configured to accept a cooling fluid stream and a pressurized process gas stream and expel them through separate outlets, expel them together through a single outlet, or both.

Cold-Spray Deposition Cooling Jacket

The present disclosure also provides a cooling jacket for a cold-spray nozzle, the cooling jacket including a rigid body 101, a nozzle channel 102, an outer channel 103, one or more bore holes 104 which can constitute cooling fluid inlets 105 and one or more cooling fluid outlets 106. The nozzle channel may extend through the rigid body to provide nozzle port 107 on each end which constitutes a nozzle entry port to a nozzle exit port. The outer channel may be oriented coaxial to the nozzle channel and extend at least a portion of the length of the nozzle channel. The one or more cooling fluid inlets and one or more cooling fluid outlets may be in communication with the outer channel. The cooling fluid inlet or inlets may provide a compressed cooling fluid to the outer channel. The cooling fluid outlet or outlets may communicate with the outer channel to an area of ambient pressure. The cooling jacket is configured to secure placement of the cold-spray nozzle 108 through the length of the nozzle channel.

The outer channel may be in communication with the nozzle channel.

The outer channel may be separated from the nozzle channel by a wall.

The nozzle entry port and nozzle exit port may have a diameter approximately the diameter of the cold-spray nozzle.

In various embodiments, the compressed cooling fluid flows through the one or more cooling fluid inlets into the outer channel and expands, vaporizes, or both, inside the outer channel.

The cooling jacket may be configured to align the outer channel with at least one of a converging segment, a diverging segment and a throat segment of the cold-spray nozzle.

The cooling jacket may comprise two or more cooling fluid inlets.

The cooling jacket may comprise a greater number of cooling fluid inlets than cooling fluid outlets.

The cooling fluid inlets may have a greater area than the cooling fluid outlets.

The cooling fluid inlets may be positioned to direct compressed cooling fluid to flow, expand, vaporize, cool or a combination thereof, through the entire length of the outer channel.

The cooling jacket may comprise one or more cooling fluid pumps which provide compress cooling fluid from a cooling fluid source and provide compressed cooling fluid to the one or more cooling fluid inlets.

The cooling jacket may comprise two or more cooling fluid pumps are linked to continuously compress cooling fluid from the cooling fluid source and continuously provide compressed cooling fluid to the one or more cooling fluid inlets. The cooling pumps may be configured to provide the compressed cooling fluid at a flow rate of at least or about 50 mL/min, 55 mL/min, 60 mL/min, 65 mL/min, 70 mL/min, 75 mL/min, 80 mL/min, 85 mL/min, 90 mL/min, 95 mL/min, 100 mL/min, 105 mL/min, 110 mL/min, 115 mL/min, 120 mL/min, 130 mL/min, 150 mL/min, 160 mL/min, 170 mL/min, 180 mL/min, 190 mL/min, or 200 mL/min.

The cooling jacket may be placed around a cold-spray nozzle. The jacket may be placed around the full circumference of the cold-spray nozzle or it may be placed partially around the circumference of the cold-spray nozzle. The jacket may fully surround the circumference of the cold-spray nozzle or it may partially surround the circumference. The jacket may be placed all the entire length of the cold-spray nozzle or a portion of the length. The jacket may be flexible or rigid. The jacket may be a sleeve. In various embodiments, the jacket does not cover over the inlet or outlet of cold-spray nozzle so as not to interfere with its use.

The cooling jacket may be shaped to wrap partially or fully around the converging-diverging nozzle.

The cooling jacket may be stainless-steel. The cooling jacket may be tungsten carbide. The cooling jacket may be a material having high thermal conductivity.

The cooling jacket may be a cylindrical structure, or other elongated structure, having a central chamber. The cooling jacket may thus be tubular. The cooling jacket may be an elongated structure, having at each base, the nozzle entry port and the nozzle exit port. The nozzle entry port and the nozzle exit port may form a partial or full seal with the cold-spray nozzle so as to isolates the outer channel from ambient air.

The cooling jacket may comprise a central chamber having a volume at least sufficient to accept the cold-spray nozzle and may be larger such that when the cold-spray nozzle is placed in the cooling jacket there remains unfilled space in the chamber surrounding the cold-spray nozzle. A channel may be formed when the cold-spray nozzle is placed in the cooling jacket where the channel is between the outer wall of the cold-spray nozzle and the inner walls of the cooling jacket. The cooling jacket and the cold-spray nozzle together may constitute a concentric nozzle.

The cooling jacket may include a thermocouple placed in contact with the outside wall of the cold-spray nozzle.

The cooling jacket may be wrapped with insulation, such as glass wool, to minimize temperature loss and maintain the duration of cooling.

The cooling jacket may be configured to feed used cooling fluid through the cooling fluid outlet to a cooling fluid recirculation system to feed back to the cooling fluid pump.

FIG. 1A illustrates one example of a cooling jacket 100 that can be used to cool a cold-spray nozzle. This example of a cooling jacket is a hollow cylinder having a rigid body 101, a length of 5.00 (relative measurement, may be, e.g., inches or cm), a diameter of 1.68, an inner channel 102 through the length of the jacket with a diameter of 0.52, an outer channel 103 coaxial to the inner channel extending an additional 0.19 radially and shortened lengthwise to terminate 0.25 from each base, the cylinder base having a nozzle port 107 in communication with the inner channel and the cylinder side having multiple bore holes 104. Two sets of four bore holes are positioned in the side of the cylinder 1.00 from each base, the bore holes distributed circumferentially at 90° increments, and another set of four bore holes are positioned 1.5 away from the other boreholes and circumferentially offset by 45°. Such bore holes constitute cooling fluid inlets 105 and cooling fluid outlets 106. This is just one example of the cooling jacket of the present disclosure, which also includes a cooling jacket having some or none of these particular measurements, orientation of bore holes or numbers of bore holes. Measurement values referred to with respect to FIG. 1A are understood as approximate, relative measurements.

Figure 1B:
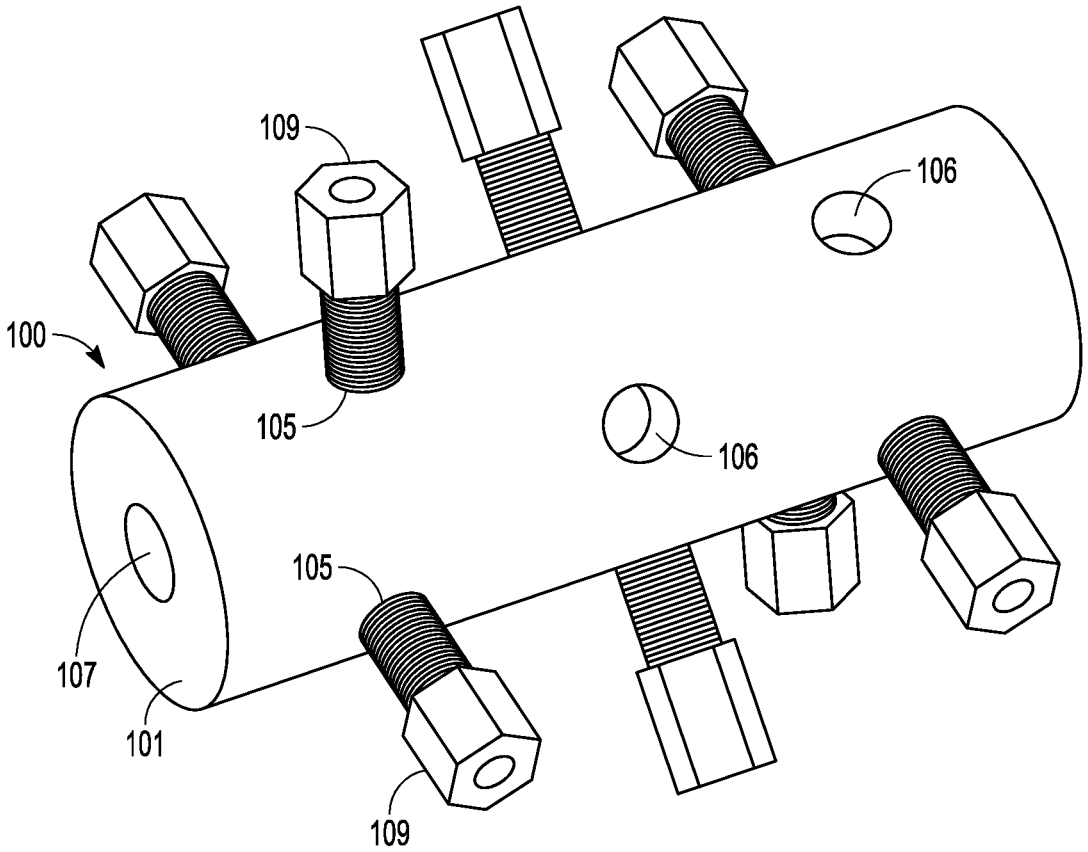
FIG. 1B provides a cooling jacket with connectors at inlets for compressed cooling fluid, in accordance with various embodiments.

FIG. 1B illustrates one example of a cooling jacket 100 and shows fluid line connectors 109 at the cooling fluid inlets 105. The open bore holes on the side are cooling fluid outlets 106 and the open bore hole at the base of the cylinder is a nozzle port 107 which is in communication with the inner chamber. In this example, 8 of the 12 bore holes configured as inlets, two of the outlets are oriented centrally and one outlet is oriented near each terminal of the jacket. This illustration shows the cooling jacket without a cold-spray nozzle in place.

Figure 1C:
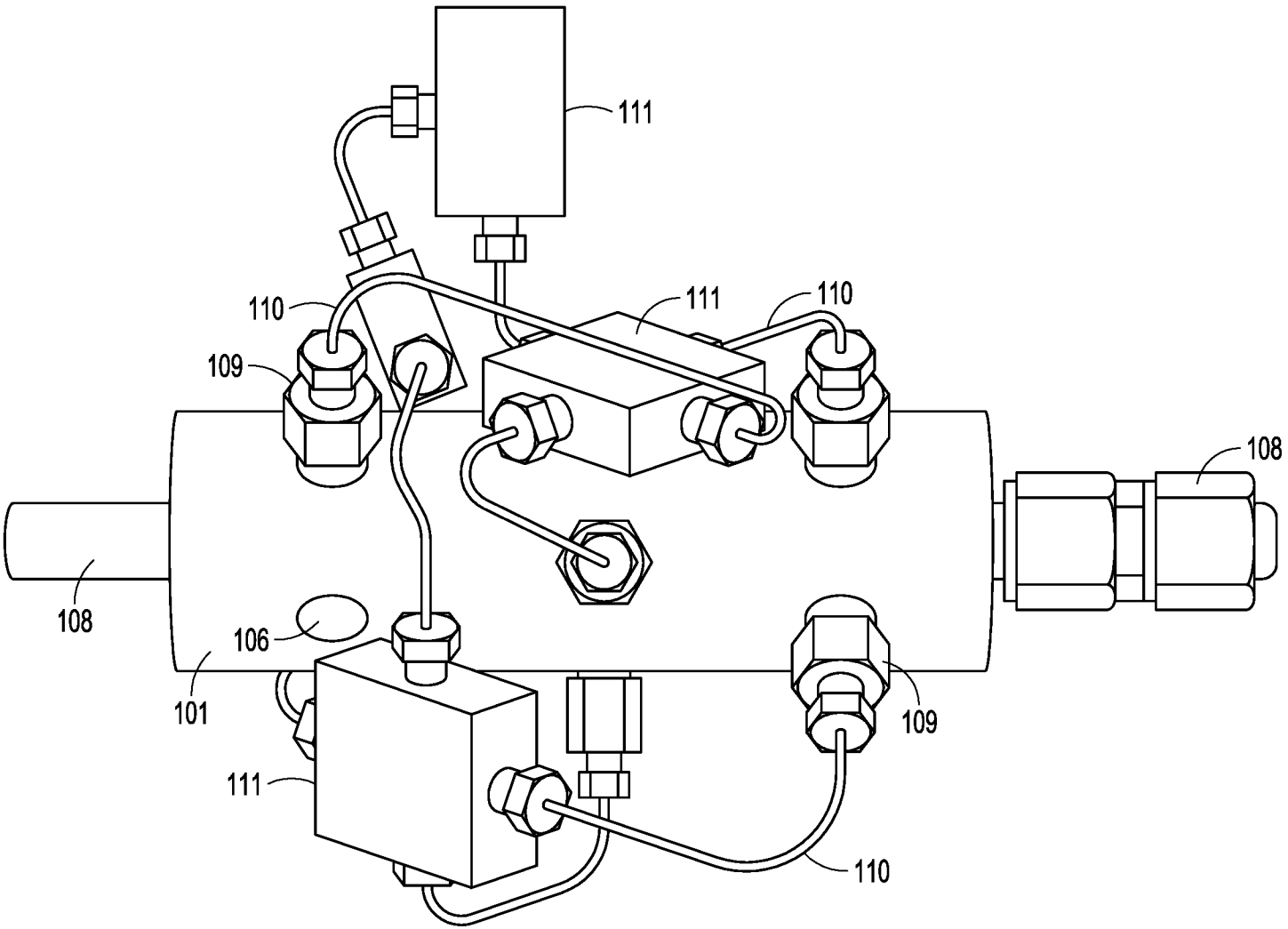
FIG. 1C provides a cooling jacket around a cold-spray nozzle, the cooling jacket including connectors and lines for providing compressed cooling fluid, in accordance with various embodiments.

FIG. 1C is a photograph of one example of a cooling jacket which has a cold-spray nozzle 108 placed through the cooling jacket and showing compressed fluid lines 110 connected to compressed fluid line connectors 109 and fluid inlets 105 and showing an open compressed fluid outlet 106 and optional cross fittings 111.

Cold-Spray Deposition System

The present disclosure also provides a cold-spray deposition system, comprising any spray head or cooling jacket described herein.

The cold-spray deposition system may be a portable cold-spray deposition system weighing less than 1500 lbs. In various embodiments, the cold-spray deposition system may be transportable via automobile or may be carried by one or more persons. The cold-spray deposition system may be configured to be carried in one or more backpacks and may be configured for field use. The cold-spray deposition system may have wheels.

The present disclosure also provides a cold-spray deposition product prepared by cold-spraying a powder containing nickel, at a pressure of about 30 bar and a temperature of about 350° C. to about 600° C., through a cold-spray nozzle for 6, 10, 15, or 20 or more minutes. Temperature and pressure values correspond to the nozzle entrance or the gas-powder mixture entering the nozzle. The temperature may be about 600° C. The cold-spray nozzle may be cooled by gas expansion or vaporization.

Nozzle

The nozzle may be a converging-diverging nozzle. The nozzle may be a de laval nozzle. The nozzle may comprise a primary channel having a converging segment, a throat and a diverging segment. In various embodiments, the nozzle has an inner channel and an outer channel. The inner channel may be a de laval nozzle. The nozzle can be configured so the pressurized powder-gas mixture flows through the inner channel. The nozzle may be a concentric nozzle. The inner channel of the concentric nozzle may be a de laval nozzle. The converging segment may converge at about a 30° angle.

The converging segment may converge at an angle from about 10° to about 50°. The diverging segment may diverge at about a 5° angle. The diverging segment may diverge at an angle from about 1° to about 30°. The nozzle may have a cooling jacket surrounding it. The nozzle may also be a tube having a valve which may be turned on or off, or optionally turned between on and off such that the valve may control the extent the flow is throttled.

Compressed Cooling Fluid

The compressed cooling fluid may be $CO_2$, air, argon, $N_2$ or a combination thereof. The compressed cooling fluid may be other than $H_2O$. In various embodiments, the compressed cooling fluid may also have a liquid-vapor critical point between a pressure of 25-150 bar and a temperature of 250-350 K, or liquid-vapor critical point between a pressure 3.5-5 MPa and a temperature of 290-380 K. The compressed cooling fluid may be a halogenated hydrocarbon, for example, a chlorofluorocarbon, a fluorocarbon, and mixtures thereof. The compressed cooling fluid may a refrigerant, for example, R134a, R410a, R503, R507a, and mixtures thereof. The compressed cooling fluid may be recycled cooling fluid (e.g., via recirculation), which was previously used in the system, jacket or method of the present disclosure.

The compressed cooling fluid may be in liquid form, vapor form, or a combination thereof. The compressed cooling fluid may exhibit a positive Joule-Thomson coefficient as it expands and the fluid may expand isenthalpically. The compressed cooling fluid may be a cooling gas.

The compressed cooling fluid may be provided continuously.

The compressed cooling fluid may be provided at a flow rate of at least or about 50 mL/min, 55 mL/min, 60 mL/min, 65 mL/min, 70 mL/min, 75 mL/min, 80 mL/min, 85 mL/min, 90 mL/min, 95 mL/min, 100 mL/min, 105 mL/min, 110 mL/min, 115 mL/min, 120 mL/min, 130 mL/min, 150 mL/min, 160 mL/min, 170 mL/min, 180 mL/min, 190 mL/min, or 200 mL/min.

The compressed cooling fluid may expand inside a spray head, prior to entering a spray head or it may expand upon exiting the spray head. The compressed cooling fluid may flow through a secondary channel in the spray head. The secondary channel may be separated from the converging-diverging nozzle such that gas or fluid flowing through the secondary channel does not mix with gas or fluid flowing through the converging-diverging nozzle. The secondary channel may be an outer channel of a concentric nozzle where the inner nozzle is a converging-diverging nozzle. The compressed cooling fluid may be provided to the spray head through a cooling fluid pump. The compressed cooling fluid may flow around or through the cold-spray nozzle.

The compressed cooling fluid may cool during expansion from a compressed state to a less compressed state or expanding to ambient pressure. The compressed cooling fluid may cool due to phase transition such as vaporization or sublimation.

The cooling fluid may cool to a temperature of at least −80° C., −79° C., 78° C.,−77° C., −76° C., −75° C., −74° C., −73° C., −72° C., −71° C., −70° C., −69° C., −68° C., −67° C., −66° C., −65° C.,−64° C., −63° C., −62° C., −61° C., −60° C., −59° C., −58° C., −57° C., −56° C., −55° C., −54° C., −53° C., −52° C.,−51° C., −50° C., −49° C., −48° C., −47° C., −46° C., −45° C., −44° C., −43° C., −42° C., −41° C., −40° C., −39° C.,−38° C., −37° C., −36° C., −35° C., −34° C., −33° C., −32° C., −31° C., −30° C., −29° C., −28° C., −27° C., −26° C.,−25° C., −24° C., −23° C., −22° C., −21° C. or −20° C.

The outside wall of the cold-spray nozzle may be cooled by about 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C. or 400° C.

The outside wall of the cold-spray nozzle may be cooled to a temperature of about 50° C., 60° C., 70° C., 80° C., 90° C., 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C. or 400° C.

Powder

The powder may comprise metal particles.

The powder comprises aluminum, copper, nickel, tantalum, titanium, silver, zinc, stainless steel, nickel-based alloys, or a mixture thereof. The powder may be an alloy containing aluminum, copper, nickel, tin, zinc and cobalt. The powder may thus be a stainless steel, a brass, a bronze, a nickel super alloy, or a combination thereof. The powder may comprise copper-nickel particles. The powder may comprise nickel particles. The powder may comprise high purity nickel particles, e.g., having a purity of equal to, or at least, about 90%, 95%, 96%, 97%, 98%, 99%, 99.5%, 99.9%, 99.99%, or at least about 99.999% or more. The powder may be at least 99% nickel. The powder may be Praxair Cu-101 or Praxair Ni-914-3.

The powder may comprise particles having a particle size from about 5 to about 100 μm. The particles may have a minimum particle size of about 5 The particles may have a minimum particle size of less than, equal to, or greater than, about 5, 6, 7, 8, 9, 10, 11, 12, 13, 14, 15, 16, 17, 18, 19, 20, 21, 22, 23, 24, 25, 26, 27, 28, 29, 30, 31, 32, 34, 35, 36, 37, 38, 39, 40, 41, 42, 43, 44, 45, 46, 47, 48, 49, 50, 51, 52, 53, 54, 55, 56, 57, 58, 59 or 60 μm.

The particles may have a maximum particle size of about 100 μm. The particles may have a maximum particle size of less than, equal to, or greater than, about 50, 51, 52, 53, 54, 55, 56, 57, 58, 59, 60, 61, 62, 63, 64, 65, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99 or 100 μm.

The particles may have an average particle size of from about 5 to about 100 μm. The particles may have an average particle size of less than, equal to, or greater than, about 5, 6, 7, 8, 9, 10, 11, 12, 13, 14, 15, 16, 17, 18, 19, 20, 21, 22, 23, 24, 25, 26, 27, 28, 29, 30, 31, 32, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99 or 100 μm. The particles may have an average particle size of from 5 to 100 μm. The particles may have an average particle size of 5 to 50, 5 to 60, 5 to 70, 5 to 80, 5 to 90, 10 to 50, 10 to 60, 10 to 70, 10 to 80, 10 to 90, 20 to 50, 20 to 60, 20 to 70, 20 to 80, 20 to 90, 30 to 50, 30 to 60, 30 to 70, 30 to 80, 30 to 90, 40 to 50, 40 to 60, 40 to 70, 40 to 80, 40 to 90, 50 to 60, 50 to 70, 50 to 80, 50 to 90, 60 to 70, 60 to 80, 60 to 90, 70 to 80 or 70 to 90 μm.

Process Gas

The process gas may comprise helium, nitrogen, air, or a mixture thereof. In various embodiments, the process gas may be free of helium.

The process gas may be at a temperature below the melting point of the powder.

The process gas may be at a temperature below the melting point of metal particles in the powder.

In various embodiments, the process gas can further comprise the cooling fluid. The process gas may further comprise $CO_2$.

The process gas may be at a temperature of from about 100° C. to about 1000° C. and a pressure of from about 10 Bar to about 50 Bar. The process gas may be preheated to a temperature of about 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., 450° C., 460° C., 470° C., 480° C., 490° C., 500° C., 510° C., 520° C., 530° C., 540° C., 550° C., 560° C., 570° C., 580° C., 590° C., 600° C., 610° C., 620° C., 630° C., 640° C., 650° C., 660° C., 670° C., 680° C., 690° C., 700° C., 710° C., 720° C., 730° C., 740° C., 750° C., 760° C., 770° C., 780° C., 790° C., 800° C., 810° C., 820° C., 830° C., 840° C., 850° C., 860° C., 870° C., 880° C., 890° C., 900° C., 910° C., 920° C., 930° C., 940° C., 950° C., 960° C., 970° C., 980° C., 990° C. or 1000° C. The process gas may also be preheated to a temperature of from about 200° C. to about 750° C., or from about 350° C. to about 600° C. The process gas can be preheated to about 300° C., about 350° C., about 400° C., about 450° C., about 500° C., about 550° C., or about 600° C.

The process gas may be pressurized to about 10 bar, 15 bar, 20 bar, 21 bar, 22 bar, 23 bar, 24 bar, 25 bar, 26 bar, 27 bar, 28 bar, 29 bar, 30 bar, 31 bar, 32 bar, 33 bar, 34 bar, 35 bar, 36 bar, 37 bar, 38 bar, 39 bar, 40 bar, 45 bar or 50 bar. The process gas can be at a pressure of from about 10 bar to about 50 bar, from about 20 bar to about 40 bar or from about 25 bar to about 35 bar Upon entering the nozzle, the process gas or powder-gas mixture may be at a temperature of about 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., 450° C., 460° C., 470° C., 480° C., 490° C., 500° C., 510° C., 520° C., 530° C., 540° C., 550° C., 560° C., 570° C., 580° C., 590° C. or 600° C.

Upon passing through the throat of a nozzle, the process gas or powder-gas mixture may be at a temperature of about 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., 450° C., 460° C., 470° C., 480° C., 490° C., 500° C., 510° C., 520° C., 530° C., 540° C., 550° C., 560° C., 570° C., 580° C., 590° C. or 600° C.

The process gas or powder-gas mixture may be transmitted through the cold-spray nozzle at a velocity of about 300 to about 1200 m/s, a velocity of about 300 m/s, 350 m/s, 400 m/s, 450 m/s, 500 m/s, 550 m/s, 600 m/s, 650 m/s, 700 m/s, 750 m/s, 800 m/s, 850 m/s, 900 m/s, 950 m/s, 1000 m/s, 1050 m/s, 1100 m/s, 1150 m/s or 1200 m/s. The gas powder may also be accelerated to a velocity of about 300 to about 1200 m/s, a velocity of about 300 m/s, 350 m/s, 400 m/s, 450 m/s, 500 m/s, 550 m/s, 600 m/s, 650 m/s, 700 m/s, 750 m/s, 800 m/s, 850 m/s, 900 m/s, 950 m/s, 1000 m/s, 1050 m/s, 1100 m/s, 1150 m/s or 1200 m/s. The accelerated powder-gas mixture may be sonic. The accelerated powder-gas mixture may be supersonic.

Cooling Fluid Pump

Cooling fluid may be transferred to the cooling jacket or spray head through one or more cooling fluid pumps. Cooling fluid may be transferred via fluid lines from the cooling fluid source, to the cooling fluid pump and to the cooling jacket or spray head. In various embodiments, cooling fluid may be transferred to the cooling jacket and spray head through two or more cooling fluid pumps. The cooling fluid pump may be a high-pressure syringe pump. The cooling fluid pump may be a twin-linked high-pressure syringe pump. The cooling fluid pump may be an ISCO 500D pump. A two-pump system can allow continuously feeding cooling fluid to the cooling jacket or spray head.

The one or more cooling fluid pumps may be configured such that once the cooling fluid reaches the desired pressure inside the pumps, an exit valve is opened and the cooling fluid expands through the fluid lines.

The cooling fluid pump may compress the cooling fluid, cool the cooling fluid, or both. The cooling fluid pump may cool the cooling fluid to ambient temperature. The cooling fluid pump may cool the cooling fluid to below ambient temperature. The cooling fluid pump may accept cooling fluid from a gas or fluid tank. The cooling fluid pump may accept cooling fluid from a cooling fluid recirculating system, which captures cooling fluid from the cooling fluid outlet of the cooling jacket.

The cooling fluid pump may provide compressed cooling fluid from a compressed fluid cannister. The cannister may be of various sizes and contain cooling fluid at various pressures. The cannister may be portable. For example, the cannister may contain about 200 ml, 300 ml, 400 ml, 500 ml, 600 ml, 700 ml, 800 ml, 900 ml, 1000 ml, 1100 ml, 1200 ml, 1300 ml, 1400 ml, 1500 ml, 1600 ml, 1700 ml, 1800 ml, 1900 ml or 2000 ml. A 500 ml cannister may provide, in various embodiments, 10 minutes of cooling for a cold-spray nozzle. The compressed fluid cannister may contain recycled cooling fluid obtained from the cooling fluid outlet of the cooling jacket.

The cooling fluid pump may provide recycled cooling fluid, e.g., $CO_2$, which is circulated and then recirculated in a cycle between the cooling jacket and the cooling fluid pump. Thus, the method, cooling jacket, spray head and system of the present disclosure may further comprise a cooling fluid recirculation system. The method, cooling jacket, spray head and system of the present disclosure may thus further comprise a $CO_2$ recirculation and refrigeration system.

The cooling fluid pump may be integrated into the cooling jacket, the spray head, the nozzle, the fluid lines or the cooling fluid source. The cooling fluid pump may be miniaturized.

Additional Advantages

In various embodiments, the cooling jacket, spray head and method of the present disclosure may reduce the temperature outside of a cold-spray deposition nozzle and can reduce the frequency or risk of clogging of the nozzle during cold-spray deposition.

The cooling jacket, spray head and method of the present disclosure may increase the time until first clog or the volume of powder sprayed until first clog, thus permitting extended cold-spray deposition.

The cooling jacket, spray head and method of the present disclosure may extend the duration by which a spray nozzle may be used in old-spray deposition by at least or about 1, 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 21, 22, 23, 24, 25, 26, 27, 28, 29, 30, 31, 32, 33, 34, 35, 36, 37, 38, 39 or 40 minutes, continuously, without clogging.

The cooling jacket, spray head and method of the present disclosure may provide reduced clogging during cold-spray deposition performed at about 100° C. to about 1000° C., at about 350° C. to about 600° C., or at about 100° C., 110° C., 120° C., 130° C., 140° C., 150° C., 160° C., 170° C., 180° C., 190° C., 200° C., 210° C., 220° C., 230° C., 240° C., 250° C., 260° C., 270° C., 280° C., 290° C., 300° C., 310° C., 320° C., 330° C., 340° C., 350° C., 360° C., 370° C., 380° C., 390° C., 400° C., 410° C., 420° C., 430° C., 440° C., 450° C., 460° C., 470° C., 480° C., 490° C., 500° C., 510° C., 520° C., 530° C., 540° C., 550° C., 560° C., 570° C., 580° C., 590° C. or 600° C. Temperature values correspond to the nozzle entrance or the gas-powder mixture entering the nozzle. In various embodiments, the temperature may be measured within the nozzle or against the outer diameter of the nozzle.

The cooling jacket, spray head and method of the present disclosure may provide reduced clogging during cold-spray deposition performed at about 10 bar, 15 bar, 20 bar, 21 bar, 22 bar, 23 bar, 24 bar, 25 bar, 26 bar, 27 bar, 28 bar, 29 bar, 30 bar, 31 bar, 32 bar, 33 bar, 34 bar, 35 bar, 36 bar, 37 bar, 38 bar, 39 bar, 40 bar, 45 bar or 50 bar.

The cooling jacket, spray head and method of the present disclosure may permit cold-spray deposition conditions having a combination of particles, temperatures, pressures and spray duration which would otherwise result in a clogged nozzle in less than or about 0.01, 0.05, 0.1, 0.2, 0.3, 0.4, 0.5, 0.6, 0.7, 08, 0.9, 1, 1.5, 2, 2.5, 3, 3.5 or 4 minutes.

For example, the present disclosure can provide a method of cold-spray deposition of nickel particles at a temperature of about 200° to about 1000° C., e.g., 350° C., 360° C., 370° C., 380° C., 390° C., 400° C., 410° C., 420° C., 430° C., 440° C., 450° C., 460° C., 470° C., 480° C., 490° C., 500° C., 510° C., 520° C., 530° C., 540° C., 550° C., 560° C., 570° C., 580° C., 590° C. or 600° C., and a pressure of 20-40 bar, e.g., 30 bar, for about or at least 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 21, 22, 23, 24, 25, 26, 27, 28, 29, 30, 31, 32, 33, 34, 35, 36, 37, 38, 39 or 40 minutes without clogging. In some embodiments, the method can be performed indefinitely without clogging. Such temperatures and pressure may be measured based on the temperature values corresponding to the nozzle entrance or the gas-powder mixture entering the nozzle. In various embodiments, the temperature may be measured within the nozzle or against the outer diameter of the nozzle.

The cooling jacket, spray head and method of the present disclosure may increase the working life of cold-spray nozzles or may reduce the extent of clogging, for example, such that a greater proportion of clogged nozzles can be cleaned and that fewer nozzles need to be discarded.

The present disclosure also provides use of any cooling jacket, spray head, or cold-spray deposition system described herein.

The present disclosure also provides a method of cooling a cold-spray nozzle, comprising placing a cold-spray nozzle through any cooling jacket described herein and providing a compressed cooling fluid thereto. The present disclosure also provides a spray head comprising a cold-spray nozzle placed through any cooling jacket described herein.

The present disclosure also provides a deposition product produced by the cold-spray method of the present disclosure.

EXAMPLES

Various embodiments of the present disclosure can be better understood by reference to the following Examples which are offered by way of illustration. The present disclosure is not limited to the Examples given herein.

Cold-Spray System

Tests were carried out in a VRC Gen III cold-spray system (VRC, Metal Systems, Rapid City, S. Dak.) with a tungsten carbide nozzle material (nozzle dimensions: 0.5" OD, 0.068" or 0.058" throat, 0.200" exit 5° or 10°). The system was configured to use He as the process gas.

Cold-Spray Powder

Two different cold-spray powder materials were investigated. The first was a copper-nickel (Praxair Cu-101, Praxair, Danbury, Conn.) and the second a high purity nickel (Praxair Ni-914-3, Praxair, Danbury, Conn.).

Preparation of Cooling Jacket Used in Examples

A cooling jacket was prepared as illustrated in FIGS. 1A-1C. The cooling jacket had tubular stainless-steel structure with 12 concentric bores along its entire length and 2 bores in both bases that allow the jacket to be placed around the nozzle. The jacket was configured such that once a nozzle is placed, there is a chamber where the expansion of the compressed fluid can take place. Through 9 of the side holes, 1/16" stainless steel pipelines are connected and can introduce the compressed fluid into the expansion chamber, leaving 3 side holes completely open as a way out of the released gas. The arrangement was such that the cooling due to the expansion of the compressed fluid takes place in the most homogeneous manner along the entire length of the nozzle.

A thermocouple placed in contact with the nozzle outside wall provides the temperature reading during the cooling process. The whole system was wrapped with a glass wool insulation material to minimize any temperature losses to the outside and maintain the cooling for as long as possible.

The jacket was connected to a twin-linked high-pressure ISCO 500D syringe pumps which were further connected to a $CO_2$ tank. The pumps were used to cool and compress the $CO_2$ to the pressure required. The $CO_2$ tank and two-pump system allowed continuously feeding, compressing and providing $CO_2$. For example, when one of the pumps runs out of gas, the second ones comes into play meanwhile the first one starts to be refilled so the cooling system can run during the whole cold-spray operation time. In Examples 1-7, the pumps were configured to open the exit valves when $CO_2$ reaches the desired pressure inside the pumps. In Examples 2-7, the pumps provided a $CO_2$ flow of about 40 mL/min. In Examples 9-14, the pumps were configured to provide a $CO_2$ flow of 100 mL/min. In both cases, the $CO_2$ expanded adiabatically through the pipelines connected to and through the cooling jacket. During this adiabatic expansion the nozzle and surrounding areas decreases dramatically in temperature. The Cooler TC temperature, reported in Tables 1 and 2, corresponds to the temperature as provided by the thermocouple on the outer wall of the nozzle. In a workbench test setting, the cooling jacket achieved a cooled the outside wall temperature of the nozzle to below −70° C.

Example 1

Copper-nickel powder was sprayed at 30 bar helium and 425° C. applicator temperature conditions in a tungsten carbide nozzle having a 0.068" throat, 0.200" exit, and 10° nozzle. Tungsten carbide nozzle known to clog. Cold-spray was performed with the cooling jacket in place but without sufficiently providing $CO_2$. For example, the insufficient $CO_2$ may be $CO_2$ which was provided at a low flow, a low amount of $CO_2$, non-compressed or poorly compressed $CO_2$, non-continuously provided $CO_2$, or $CO_2$ which was not provided homogenously to the gas expansion chamber. Initial temperatures and pressure values corresponding temperature and pressure of the gas-powder mixture entering the nozzle.

The thermocouple indicated that the nozzle was successfully cooled to 312° C. by use of a cooling jacket with at least some about of $CO_2$.

However, the copper-nickel powder clogged the nozzle after 2.5 minutes of experiment which is similar to the time until clog for this type of material and nozzle without the cooling jacket, thus showing that sufficient $CO_2$ is needed to prevent clogging or extend spray time.

Examples 2-7

High purity nickel powder was sprayed at 30 bar helium and a range of applicator temperature conditions in a tungsten carbide 0.058" throat, 0.200" exit 5° nozzle (Examples 2-7). The first spray condition used was a 350° C. applicator temperature (Example 2), which is the standard spray condition used for Praxair Ni-914-3 powder. The applicator temperature was incrementally increased by 50° C. from 350° C. to 400° C. (Example 3), 450° C. (Example 4), 500° C. (Example 5), 550° C. (Example 6) and then to 600° C. (Example 7). Cold-spray was performed with the cooling jacket in place and compressed $CO_2$ was provided continuously at a flow of about 40 mL/min from twin-linked high-pressure ISCO 500D syringe pumps. Initial temperatures and pressure values correspond to the temperature and pressure of the gas-powder mixture entering the nozzle.

Each trial lasted approximately 6-15 minutes.

Results are set forth in Table 1. Each of the experiments provided extended cold-spray deposition durations compared to what is typically achievable under similar cold-spray conditions. Each of the experiments showed substantial cooling of the nozzle.

None of the experiments using the cooling jacket suffered from clogged nozzle.

Example 8

High purity nickel powder was sprayed at 30 bar helium and 600° C. applicator temperature conditions in a tungsten carbide 0.058" throat, 0.200" exit 5° nozzle. The cooling jacket was removed and the nozzle clogged after 3.5 minutes of experiment.

TABLE 1

Cooling Jacket Test

| | Powder | Nozzle | Cold-spray Conditions | Cooling | Clog | Time (min) | Cooler TC (° C.) |
|---|---|---|---|---|---|---|---|
| Example 1 | Cu-101 | WC 0.068" × 0.200" 10° | He, 30Bar, 425° C. applicator | Yes | Yes | 2.5 | 312 |
| Example 2 | Ni-914-3 | WC 0.058" × 0.200" 5° | He, 30Bar, 350° C. applicator | Yes | No | 6 | 81 |
| Example 3 | Ni-914-3 | WC 0.058" × 0.200" 5° | He, 30Bar, 400° C. applicator | Yes | No | 6 | 109 |
| Example 4 | Ni-914-3 | WC 0.058" × 0.200" 5° | He, 30Bar, 450° C. applicator | Yes | No | 14.5 | 187 |
| Example 5 | Ni-914-3 | WC 0.058" × 0.200" 5° | He, 30Bar, 500° C. applicator | Yes | No | 9.5 | 210 |
| Example 6 | Ni-914-3 | WC 0.058" × 0.200" 5° | He, 30Bar, 550° C. applicator | Yes | No | 8 | 255 |
| Example 7 | Ni-914-3 | WC 0.058" × 0.200" 5° | He, 30Bar, 600° C. applicator | Yes | No | 9.5 | 288 |
| Example 8 | Ni-914-3 | WC 0.058" × 0.200" 5° | He, 30Bar, 600° C. applicator | No | Yes | 3.5 | 368 |

Examples 9-14

The method was performed according to the method of Examples 2-7, except the $CO_2$ was configured to have a vastly increased flow of $CO_2$ of 100 mL/min instead of a flow of about 40 mL/min. Each of Example 9-14 utilized a high purity nickel powder, Ni-914-3, sprayed at 30 bar helium and a range of applicator temperature conditions in a tungsten carbide 0.058" throat, 0.200" exit 5° nozzle. The cold-spray conditions were tested at various temperatures: 350° C. (Example 9), 400° C. (Example 10), 450° C. (Example 11), 500° C. (Example 12), 550° C. (Example 13) and 600° C. (Example 14). Examples 9-12 were each performed for 20 minutes without clogging. Examples 13 and 14 were performed for about 14 and about 13 minutes, respectively, at which point cooling was terminated due to malfunction on the pump controller. Once cooling stopped, the nozzle clogged almost immediately. In each of Examples 9-14, cold-spray was performed with the cooling jacket in place and compressed $CO_2$ was provided at a flow rate of 100 mL/min continuously from twin-linked high-pressure ISCO 500D syringe pumps. Initial temperatures and pressure values of the cold-spray conditions correspond to the temperature and pressure of the gas-powder mixture entering the nozzle. The Cooler TC temperature corresponds to the temperature as provided by the thermocouple on the outer wall of the nozzle.

TABLE 2

High flow rate $CO_2$ Examples

| | Powder | Nozzle | Cold-spray Conditions | Cooling/$CO_2$ Flow | Clog | Time (min) | Cooler TC (° C.) |
|---|---|---|---|---|---|---|---|
| Example 9 | Ni-914-3 | WC 0.058" × 0.200" 5° | He, 30Bar, 350° C. applicator | 100 mL/min | No | 20 | 95 |
| Example 10 | Ni-914-3 | WC 0.058" × 0.200" 5° | He, 30Bar, 400° C. applicator | 100 mL/min | No | 20 | 103 |
| Example 11 | Ni-914-3 | WC 0.058" × 0.200" 5° | He, 30Bar, 450° C. applicator | 100 mL/min | No | 20 | 132 |
| Example 12 | Ni-914-3 | WC 0.058" × 0.200" 5° | He, 30Bar, 500° C. applicator | 100 mL/min | No | 20 | 157 |
| Example 13 | Ni-914-3 | WC 0.058" × 0.200" 5° | He, 30Bar, 550° C. applicator | 100 mL/min, then stopped at about 14 min | Yes, upon flow stop | 14 | 195 |
| Example 14 | Ni-914-3 | WC 0.058" × 0.200" 5° | He, 30Bar, 600° C. applicator | 100 mL/min, then stopped at about 13 min | Yes, upon flow stop | 13 | |

Examples 15-16

The method is performed according to Examples 13-14, except the cold-spray process is conducted for at least or about 20 minutes and the 100 mL/min flow of $CO_2$ is not stopped until the experiment is complete.

No clogging is observed after 20 minutes.

Discussion

The cold-spray experiments were run under conditions which represent a variety of particles and wide range of operation temperatures. The results of Tables 1 and 2 show that the cooling jacket effectively removed heat from the nozzle, reducing the temperature by cooling the outside of the nozzle.

The results show that the cooling jacket prevented the appearance of clogging, even for systems and operation temperatures that would otherwise clog at short operation times without a cooling jacket. Examples 2-7 show that the cooling jacket cooled the nozzle to a temperature of 269° C. to 312° C. below the applicator temperature. A comparison of Examples 7 and 8 shows that the cooling jacket is effective for conditions which would otherwise clog within 3.5 minutes. These results are also a vast improvement compared to water-cooled attempts to cool cold-spray nozzles. (X. Wang, B. Zhang, J. Lv, and S. Yin. Investigation on the Clogging Behavior and Additional Wall Cooling for the Axial-Injection Cold Spray Nozzle. Journal of Thermal Spray Technology, 24 (4), 696-701, 2015).

Examples 13 and 14 show that spray times of more than 10 minutes at temperatures 550° C. and higher will clog almost immediately if the flow of cooling fluid is disrupted. Examples 9-14 show that use of a higher 100 mL/min rate of $CO_2$ delivery results in further improved cooling and even longer spray times, for example, spray times of 20 minutes without clogging. The examples show that use of a cooling jacket of the present disclosure can extend the permissible duration of cold-spray deposition by more than double compared to cold-spray deposition without the cooling jacket. The cooling jacket also permits cold-spray at temperatures up to 600° C.

The jacket cooled by compressed $CO_2$ thus provides faster and more effective cooling for the cold-spray nozzle and permits longer spray times without encountering clogs at a variety of temperatures.

Helium is currently used as a process gas for cold-spray deposition because it is easily accelerated to high velocity at relatively low temperatures. The present invention provides a method and a cooling jacket which will permit other process gases to be used where helium is currently required. For example, the present invention will permit use of nitrogen as a process gas. By taking advantage of the cooling described herein, gases which require higher temperatures to achieve the same velocity can be used without the problem of clogging.

Nickel is also used in cold-spray deposition and various nickel mixtures can be suitably sprayed around, for example, 350° C. to 425° C. The results herein show that the present invention can be used at higher temperatures without the problem of clogging. Thus, the cooling jacket described herein can permit use of other types of metal, which would otherwise require temperatures of greater than 450° C. and thus risk clogging.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present disclosure. Thus, it should be understood that although the present disclosure has been specifically disclosed by specific embodiments and optional features, modification and variation of the concepts herein disclosed may be resorted to by those of ordinary skill in the art, and that such modifications and variations are considered to be within the scope of embodiments of the present disclosure.

ADDITIONAL EMBODIMENTS

The following exemplary embodiments are provided, the numbering of which is not to be construed as designating levels of importance:

Embodiment 1 provides a method of cold-spray deposition comprising: mixing a powder with a heated and pressurized process gas to produce a powder-gas mixture; flowing the powder-gas mixture through a nozzle to produce an accelerated powder-gas mixture; spraying the accelerated powder-gas mixture onto a substrate to deposit the powder; and cooling the nozzle by at least one of expanding and vaporizing a compressed cooling fluid in proximity to the nozzle.

Embodiment 2 provides the method of embodiment 1, comprising expanding the compressed cooling fluid in proximity to the nozzle.

Embodiment 3 provides the method of Embodiment 1 or 2, comprising vaporizing the compressed cooling fluid in proximity to the nozzle.

Embodiment 4 provides the method of any one of Embodiments 1-3, comprising flowing the compressed cooling fluid along an outer wall of the nozzle.

Embodiment 5 provides the method of any one of Embodiments 1-4, comprising flowing the compressed cooling fluid through a spray head which comprises the nozzle and a cooling jacket which surrounds at least a portion of the nozzle.

Embodiment 6 provides the method of Embodiment 5, wherein the compressed cooling fluid is flowed through the spray head without mixing with the heated and pressurized process gas, the powder-gas mixture and the accelerated powder-gas mixture.

Embodiment 7 provides the method of Embodiment 5 or 6, comprising at least one of expanding and vaporizing the compressed cooling fluid in the spray head.

Embodiment 8 provides the method of any one of Embodiments 5-7, comprising at least one of expanding and vaporizing the compressed cooling fluid in an outer channel between an inner wall of the cooling jacket and an outer wall of the nozzle.

Embodiment 9 provides the method of any one of Embodiments 1-8, comprising at least one of expanding and vaporizing the compressed cooling fluid along an outer wall of the nozzle.

Embodiment 10 provides the method of any one of Embodiments 1-9, wherein the nozzle is a converging-diverging nozzle.

Embodiment 11 provides the method of any one of Embodiments 1-10, wherein the nozzle comprises a cooling jacket surrounding it.

Embodiment 12 provides the method of any one of Embodiments 1-11, wherein the cooling occurs at an outer wall of the nozzle.

Embodiment 13 provides the method of any one of Embodiments 1-12, wherein the nozzle is cooled at one or more of a converging segment, a diverging segment and a throat segment of the cold-spray nozzle.

Embodiment 14 provides the method of any one of Embodiments 1-13, wherein the compressed cooling fluid has a liquid-vapor critical point between a pressure of 25-150 bar and a temperature of 250-350 K.

Embodiment 15 provides the method of any one of Embodiments 1-14, wherein the compressed cooling fluid is in liquid form, vapor form, or a combination thereof.

Embodiment 16 provides the method of any one of Embodiments 1-15, wherein the compressed cooling fluid is expanded isenthalpically.

Embodiment 17 provides the method of any one of Embodiments 1-16, wherein the compressed cooling fluid exhibits a positive Joule-Thomson coefficient as it expands.

Embodiment 18 provides the method of any one of Embodiments 1-17, wherein the compressed cooling fluid is provided continuously.

Embodiment 19 provides the method of any one of Embodiments 1-18, wherein the process gas is at a temperature of from about 100° C. to about 1000° C. and a pressure of from about 10 Bar to about 50 Bar.

Embodiment 20 provides the method of any one of Embodiments 1-19, wherein the process gas comprises helium, nitrogen, argon, air, or a combination thereof.

Embodiment 21 provides the method of any one of Embodiments 1-20, wherein the process gas is free of helium.

Embodiment 22 provides the method of any one of Embodiments 1-21, wherein the accelerated powder-gas mixture has a velocity of 300 to 1200 m/s.

Embodiment 23 provides the method of any one of Embodiments 1-22, wherein the powder comprises metal particles.

Embodiment 24 provides the method of any one of Embodiments 1-23, wherein the powder comprises high purity nickel particles.

Embodiment 25 provides the method of any one of Embodiments 1-24, wherein the powder is at least 99% nickel.

Embodiment 26 provides the method of any one of Embodiments 1-25, comprising spraying for at least 6 minutes at a temperature from about 350° C. to about 600° C. with the nozzle remaining clog free.

Embodiment 27 provides the method of any one of Embodiments 1-26, comprising spraying for at least 6 minutes at 600° C. with the nozzle remaining clog free.

Embodiment 28 provides the method of any one of Embodiments 1-27, comprising spraying for at least 10 minutes at a temperature from about 350° C. to about 600° C. with the nozzle remaining clog free.

Embodiment 29 provides the method of any one of Embodiments 1-28, comprising spraying for at least 10 minutes at 600° C. with the nozzle remaining clog free.

Embodiment 30 provides the method of any one of Embodiments 1-29, comprising spraying for at least 20 minutes at a temperature from about 350° C. to about 600° C. with the nozzle remaining clog free.

Embodiment 31 provides the method of any one of Embodiments 1-30, comprising spraying for at least 20 minutes at 600° C. with the nozzle remaining clog free.

Embodiment 32 provides the method of any one of Embodiments 1-31, comprising flowing the compressed cooling fluid at a rate of at least 50 mL/min to at least a portion of the nozzle.

Embodiment 33 provides the method of any one of Embodiments 1-32, comprising flowing the compressed cooling fluid at a rate of at least 75 mL/min to at least a portion of the nozzle.

Embodiment 34 provides the method of any one of Embodiments 1-33, comprising flowing the compressed cooling fluid at a rate of at least 100 mL/min to at least a portion of the nozzle.

Embodiment 35 provides the method of any one of Embodiments 1-34, wherein the nozzle is a concentric nozzle having an inner channel and an outer channel oriented coaxially.

Embodiment 36 provides the method of Embodiment 35, wherein the powder-gas mixture flows through the inner channel, and the compressed cooling fluid flows through the outer channel.

Embodiment 37 provides the method of any one of Embodiments 1-36, wherein the compressed cooling fluid does not mix with the heated and pressurized process gas and powder-gas mixture.

Embodiment 38 provides the method of any one of Embodiments 1-37, wherein the compressed cooling fluid is mixed with the heated and pressurized process gas, the powder-gas mixture, or both.

Embodiment 39 provides a spray head for a cold-spray deposition system, the spray head comprising:

a cold-spray nozzle;

a cooling jacket coaxially oriented around the cold-spray nozzle to provide an annular outer channel between an inner wall of the cooling jacket and an outer wall of the cold-spray nozzle;

one or more cooling fluid inlets in communication with the outer channel; and one or more cooling fluid outlets which communicate the outer channel to an area of ambient pressure;

wherein the cooling fluid inlet provides a compressed cooling fluid to the outer channel and the compressed cooling fluid cools the outer wall of the cold-spray nozzle by at least one of expanding and vaporizing in the outer channel.

Embodiment 40 provides the spray head of Embodiment 39, wherein the outer channel is not in communication with the inner channel.

Embodiment 41 provides the spray head of Embodiment 39 or 40, wherein the spray head is configured to flow a process gas and powder through the cold-spray nozzle and flow a compressed cooling fluid through the inner channel.

Embodiment 42 provides the spray head of any one of Embodiments 39-41, wherein the compressed cooling fluid is provided in liquid form, vapor form, or a combination thereof.

Embodiment 43 provides the spray head of any one of Embodiments 39-42, wherein the cold-spray nozzle is configured to accept a mixture of powder and heated and pressurized process gas and to produce an accelerated powder-gas mixture.

Embodiment 44 provides the spray head of any one of Embodiments 39-43, wherein the outer channel is aligned with the outer wall of at least one of a converging segment, a diverging segment and a throat segment of the cold-spray nozzle.

Embodiment 45 provides the spray head of any one of Embodiments 39-44, wherein the compressed cooling fluid cools the outer wall of at least one of a converging segment, a diverging segment and a throat segment of the cold-spray nozzle.

Embodiment 46 provides the spray head of any one of Embodiments 39-45, wherein one or more cooling fluid inlets directs the compressed cooling fluid to the outer wall of at least one of a converging segment, a diverging segment and a throat segment of the cold-spray nozzle Embodiment 47 provides the spray head of any one of Embodiments 39-46, comprising one or more cooling fluid pump which compresses cooling fluid from a cooling fluid source and provides compressed cooling fluid to the one or more cooling fluid inlets.

Embodiment 48 provides the spray head of any one of Embodiments 39-47, comprising two or more cooling fluid pumps linked to continuously compress cooling fluid from the cooling fluid source and continuously provide compressed cooling fluid to the one or more cooling fluid inlets.

Embodiment 49 provides the spray head of any one of Embodiments 39-48, wherein one, two, or more cooling fluid pumps provide the compressed cooling fluid at a rate of at least 50 mL/min to at least a portion of the nozzle.

Embodiment 50 provides the spray head of any one of Embodiments 39-49, wherein one, two, or more cooling fluid pumps provide the compressed cooling fluid at a rate of at least 75 mL/min to at least a portion of the nozzle.

Embodiment 51 provides the spray head of any one of Embodiments 39-50, wherein one, two, or more cooling fluid pumps provide the compressed cooling fluid at a rate of at least 100 mL/min to at least a portion of the nozzle.

Embodiment 52 provides a cooling jacket for a cold-spray nozzle, the cooling jacket comprising:

a rigid body;

a nozzle channel extending through the rigid body from a nozzle entry port to a nozzle exit port;

an outer channel oriented coaxial to the nozzle channel and extending at least a portion of the length of the nozzle channel;

one or more cooling fluid inlets which provide a compressed cooling fluid to the outer channel; and one or more cooling fluid outlets which communicates the outer channel to an area of ambient pressure;

wherein the cooling jacket is configured to secure placement of the cold-spray nozzle through the nozzle channel.

Embodiment 53 provides the cooling jacket of Embodiment 52, wherein the outer channel is in communication with the nozzle channel.

Embodiment 54 provides the cooling jacket of Embodiment 52 or 53, wherein the outer channel is separated from the nozzle channel by a wall.

Embodiment 55 provides the cooling jacket of any one of Embodiments 52-54, wherein the nozzle entry port and nozzle exit port have diameter approximately the diameter of the cold-spray nozzle.

Embodiment 56 provides the cooling jacket of any one of Embodiments 52-55, wherein the compressed cooling fluid flows through the one or more cooling fluid inlets into the outer channel and expands, vaporizes, or both, inside the outer channel.

Embodiment 57 provides the cooling jacket of any one of Embodiments 52-56, wherein the cooling jacket is configured to align the outer channel with at least one of a converging segment, a diverging segment and a throat segment of the cold-spray nozzle.

Embodiment 58 provides the cooling jacket of any one of Embodiments 52-57, comprising two or more cooling fluid inlets.

Embodiment 59 provides the cooling jacket of Embodiment 58, comprising a greater number of cooling fluid inlets than cooling fluid outlets.

Embodiment 60 provides the cooling jacket of Embodiment 58 or 59, wherein the cooling fluid inlets have a greater area than the cooling fluid outlets.

Embodiment 61 provides the cooling jacket of any one of Embodiments 52-60, wherein the cooling fluid inlets are positioned to direct compressed cooling fluid to flow, expand, vaporize, cool or a combination thereof, through the entire length of the outer channel.

Embodiment 62 provides the cooling jacket of any one of Embodiments 52-61, comprising one or more cooling fluid pumps which provides compress cooling fluid from a cooling fluid source and provide compressed cooling fluid to the one or more cooling fluid inlets.

Embodiment 63 provides the cooling jacket of any one of Embodiments 52-62, comprising two or more cooling fluid pumps are linked to continuously compress cooling fluid from the cooling fluid source and continuously provide compressed cooling fluid to the one or more cooling fluid inlets.

Embodiment 64 provides the cooling jacket of any one of Embodiments 52-63, wherein one, two, or more cooling fluid pumps provide the compressed cooling fluid at a rate of at least 50 mL/min to the cooling jacket.

Embodiment 65 provides the cooling jacket of any one of Embodiments 52-64, wherein one, two, or more cooling fluid pumps provide the compressed cooling fluid at a rate of at least 75 mL/min to the cooling jacket.

Embodiment 66 provides the cooling jacket of any one of Embodiments 52-65, wherein one, two, or more cooling fluid pumps provide the compressed cooling fluid at a rate of at least 100 mL/min to the cooling jacket.

Embodiment 67 provides use of the cooling jacket of any one of Embodiments 52-66 to cool a cold-spray nozzle.

Embodiment 68 provides a method of cooling a cold-spray nozzle, comprising placing the cold-spray nozzle through the nozzle channel of the cooling jacket of any one of Embodiments 52-67 and providing a compressed cooling fluid to the cooling jacket.

Embodiment 69 provides a spray head comprising a cold-spray nozzle placed through the nozzle channel of the cooling jacket of any one of Embodiments 52-67.

Embodiment 70 provides a cold-spray deposition system, comprising the spray head of Embodiment 69.

Embodiment 71 provides the cold-spray deposition system of Embodiment 70, as a portable cold-spray deposition system weighing less than 1500 lbs.

Embodiment 72 provides a cold-spray deposition product prepared by cold-spraying a powder containing nickel, at a pressure of about 30 bar and a temperature of about 350° C. to about 600° C., through a cold-spray nozzle for 6 or more minutes.

Embodiment 73 provides the method of Embodiment 68, wherein the temperature is about 600° C.

Embodiment 74 provides the method of Embodiment 68 or 73, wherein the cold-spray nozzle is cooled by gas expansion or vaporization.

Embodiment 75 provides the apparatus, method, composition, or system of any one or any combination of Embodiments 1-74 optionally configured such that all elements or options recited are available to use or select from.

What is claimed is:

1. A method of cold-spray deposition comprising:

mixing a powder with a heated and pressurized process gas to produce a powder-gas mixture;

flowing the powder-gas mixture through a nozzle to produce an accelerated powder-gas mixture;

spraying the accelerated powder-gas mixture onto a substrate to deposit the powder; and cooling the nozzle by at least one of expanding and vaporizing a compressed cooling fluid in proximity to the nozzle such that the compressed cooling fluid undergoes a phase change;

wherein the compressed cooling fluid has a liquid-vapor critical point between a pressure of 25-150 bar and between a temperature of 250-350 K.

2. The method of claim 1, comprising flowing the compressed cooling fluid through a spray head comprising the nozzle and a cooling jacket which surrounds at least a portion of the nozzle.

3. The method of claim 2, wherein the compressed cooling fluid is flowed through the spray head without mixing with any of the heated and pressurized process gas, the powder-gas mixture and the accelerated powder-gas mixture.

4. The method of claim 2, comprising at least one of expanding and vaporizing the compressed cooling fluid in the spray head.

5. The method of claim 2, comprising at least one of expanding and vaporizing the compressed cooling fluid in an outer channel between an inner wall of the cooling jacket and an outer wall of the nozzle.

6. The method of claim 2, wherein the cooling jacket comprises:

a rigid body;

a nozzle channel extending through the rigid body from a nozzle entry port to a nozzle exit port;

an outer channel oriented coaxially to the nozzle channel and extending at least a portion of the length of the nozzle channel;

one or more cooling fluid inlets for providing a compressed cooling fluid to the outer channel; and one or more cooling fluid outlets which communicate the outer channel to an area of ambient pressure;

wherein the cooling jacket is configured to secure placement of the nozzle through the nozzle channel and the compressed cooling fluid has a liquid-vapor critical point between a pressure of 25-150 bar and a temperature of 250-350 K.

7. The method of claim 1, wherein the compressed cooling fluid is provided continuously.

8. The method of claim 1, wherein the process gas is at a temperature of from about 100° C. to about 1000° C. and a pressure of from about 10 Bar to about 50 Bar.

9. The method of claim 1, wherein the accelerated powder-gas mixture has a velocity of 300 to 1200 m/s.

10. The method of claim 1, wherein the powder comprises metal particles.

11. The method of claim 1, wherein the powder is at least 99% nickel.

12. The method of claim 1, comprising performing the spraying for at least 6 minutes at 600° C. with the nozzle remaining clog-free.

13. The method of claim 1, comprising performing the spraying for at least 10 minutes at a temperature of about 350° C. to about 600° C. with the nozzle remaining clog-free.

14. The method of claim 1, comprising performing the spraying for at least 20 minutes at a temperature of about 350° C. to about 600° C. with the nozzle remaining clog-free.

15. The method of claim 1, comprising flowing the compressed cooling fluid at a rate of at least 100 mL/min through a cooling jacket which surrounds at least a portion of the nozzle.

16. The method of claim 1, comprising flowing the compressed cooling fluid through a spray head, wherein the spray head comprises:

the nozzle, wherein the nozzle is a cold-spray nozzle;

a cooling jacket coaxially oriented around the cold-spray nozzle to provide an annular outer channel between an inner wall of the cooling jacket and an outer wall of the cold-spray nozzle;

one or more cooling fluid inlets in communication with the outer channel; and one or more cooling fluid outlets which communicate the outer channel to an area of ambient pressure;

wherein the cooling fluid inlets provide a flow pathway for a compressed cooling fluid to flow to the outer channel and cool the outer wall of the cold-spray nozzle by at least one of expanding and vaporizing in the outer channel.

17. The method of claim 16, wherein the spray head comprises one or more cooling fluid pumps which compress cooling fluid from a cooling fluid source and provide compressed cooling fluid to the one or more cooling fluid inlets.

18. The method of claim 16, wherein the spray head comprises two or more cooling fluid pumps linked to continuously compress cooling fluid from the cooling fluid source and continuously provide compressed cooling fluid to the one or more cooling fluid inlets.

19. The method of claim 18, wherein the two or more cooling fluid pumps provide cooling fluid at a rate of at least 100 mL/min.

20. The method of claim 1, wherein the compressed cooling fluid comprises carbon dioxide.

* * * * *